US009267225B2

(12) United States Patent
Erickson et al.

(10) Patent No.: US 9,267,225 B2
(45) Date of Patent: Feb. 23, 2016

(54) METHOD OF ESTIMATING BENDING MOMENT OF A LAUNDRY TREATING APPLIANCE DRUM SHAFT USING A PROXIMITY SENSOR

(75) Inventors: Donald E. Erickson, Stevensville, MI (US); Farshad Farid, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1069 days.

(21) Appl. No.: 13/334,548

(22) Filed: Dec. 22, 2011

(65) Prior Publication Data

US 2013/0160218 A1 Jun. 27, 2013

(51) Int. Cl.
*D06F 35/00* (2006.01)
*D06F 37/20* (2006.01)

(52) U.S. Cl.
CPC ..... *D06F 37/203* (2013.01)

(58) Field of Classification Search
CPC ..... D06F 37/203; D06F 37/225; D06F 33/02; F03D 7/0224; F05B 2270/1095
USPC ..... 68/23.1, 12.02, 23.2, 12.06, 12.04, 68/12.14, 12.19, 12.27, 13 R; 416/1, 144, 416/35, 36, 61; 8/137, 158, 159
See application file for complete search history.

(56) References Cited

U.S. PATENT DOCUMENTS

| | | | | |
|---|---|---|---|---|
| 5,280,660 | A | 1/1994 | Pellerin et al. | |
| 2008/0134727 | A1 | 6/2008 | May | |
| 2010/0251778 | A1 * | 10/2010 | Jurmann et al. | 68/23.1 |

FOREIGN PATENT DOCUMENTS

| | | | |
|---|---|---|---|
| DE | 3117106 | A1 | 11/1982 |
| EP | 0856604 | A2 | 8/1998 |
| EP | 0736625 | B1 | 11/1999 |
| EP | 1870596 | A2 | 12/2007 |
| WO | 2010026246 | A1 | 3/2010 |
| WO | 2010123197 | A1 | 10/2010 |
| WO | WO 2010123197 | A1 * | 10/2010 |

OTHER PUBLICATIONS

European Search Report for Corresponding EP 12197275.6, Apr. 9, 2013.

* cited by examiner

*Primary Examiner* — Michael Barr
*Assistant Examiner* — Thomas Bucci

(57) ABSTRACT

Disclosed is a method of operating a laundry treating appliance having a tub, a rotatable drum within the tub, and a rotatable drive shaft supported in a bearing assembly and mounted to the drum, with the bending moment acting on the bearing assembly being determined and used as an input to control the operation of the appliance.

13 Claims, 6 Drawing Sheets

METHOD OF ESTIMATING BENDING MOMENT OF A LAUNDRY TREATING APPLIANCE DRUM SHAFT USING A PROXIMITY SENSOR

BACKGROUND OF THE INVENTION

A laundry treating appliance is a common household device for treating laundry in accordance with a preprogrammed treating cycle of operation. A subset of laundry treating appliances uses a generally horizontally rotating drum to define a chamber in which the laundry is received for treatment according to the cycle of operation. The laundry may be distributed in the drum chamber in such a way as to introduce an imbalance, and increase the bending moment, acting on the rotating drive shaft.

Shaft bending moment will increase as the drum rotational speed increases for a given imbalance. Because the magnitude of drive shaft bending moment is generally limited by design to a selected maximum, the drive shaft or drum rotational speed must be limited. Generally, motor power or torque is used to estimate the shaft bending moment, with this information utilized to determine if a design limit bending moment has been reached. However, utilizing motor power or torque to calculate drive shaft bending moment can provide inaccurate results, and can necessitate calibration each time a cycle is operated, which increases overall cycle time and vibration level.

One solution for addressing the inaccuracies in the motor power and/or torque determinations is to establish a reduced design limit for acceptable bending moment values that provides a safety margin to ensure that normal operation will not result in a failure. As a result, when the bending moment is large, the drum must be rotated at lower spin speeds, or rotated to redistribute the laundry load. For example, if a maximum bending moment limit is 400 newton-meters, a factor of safety may be provided to limit the calculated moment to 350 newton-meters, which is sufficient to account for the magnitude of the errors in motor power or torque readings.

BRIEF DESCRIPTION OF THE INVENTION

In one aspect, the invention is a method of operating a laundry treating appliance comprising a tub, a rotatable drum provided within the tub, and a drive shaft rotationally supported in a bearing assembly and having one end extending through the tub and mounted to the drum. The method includes sensing a change in the distance between the tub and the drum while the drum is rotated, equating the change in the distance to a magnitude of a bending moment acting on the bearing assembly, and controlling the operation of the laundry treating appliance based on the magnitude of the bending moment.

In another aspect, the invention is a laundry treating appliance for treating laundry according to at least one cycle of operation. The laundry treating appliance includes a tub having an open end and a closed end, a bearing assembly mounted to the closed end of the tub, a drum provided within the tub and having an open end and a closed end corresponding to the open end and closed end of the tub, respectively, a drive shaft rotatably mounted within the bearing assembly and coupled with the closed end of the drum, a motor operably coupled with the drive shaft to rotate the drive shaft and effect a rotation of the drum, at least one sensor mounted to the tub and outputting a distance signal indicative of the distance between the tub and the drum, and a controller having a memory in which is stored the at least one cycle of operation for execution, the controller providing a motor control signal to control the rotation of the drum, and receive the distance signal to control the execution of the cycle of operation. The controller equates the distance signal from the rotation of the drum with a magnitude of a moment acting on the bearing assembly, and controls the execution of the at least one cycle of operation in response to the magnitude of the moment.

DESCRIPTION OF AN EMBODIMENT OF THE INVENTION

Figure 1:
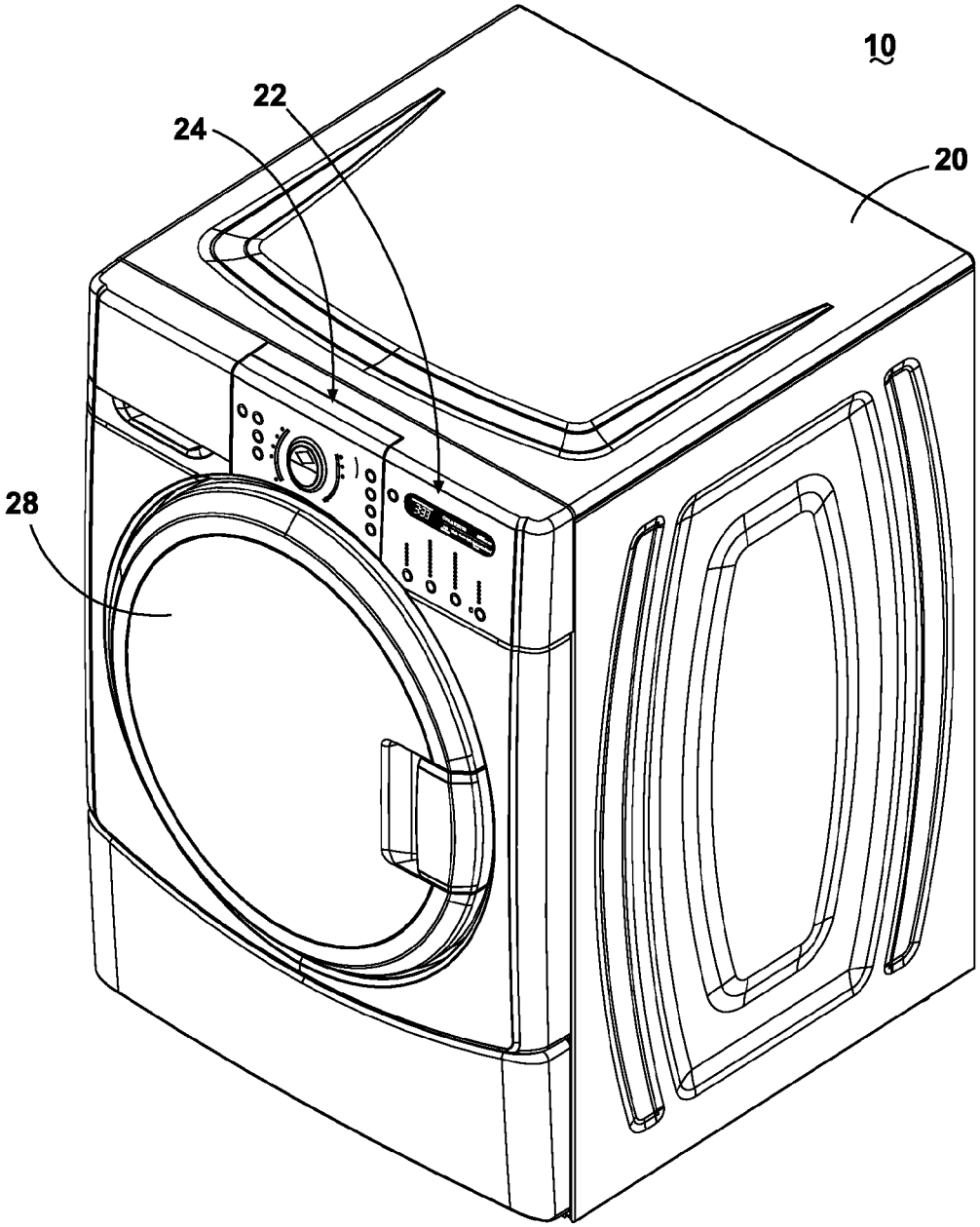
FIG. 1 is a perspective view of an exemplary laundry treating appliance according to an embodiment of the invention.

Referring now to the figures, FIG. 1 is a perspective view of a laundry treating appliance 10 according to an embodiment of the invention. For illustrative purposes, the embodiment will be described herein with respect to a washing machine for cleaning a laundry load, with it being understood that the invention may be used with other types of laundry treating appliances for treating fabric. For example, the laundry treating appliance 10 may include a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine.

The laundry treating appliance 10 may include a cabinet 20 closeable by an access door 28. A controller 22 mounted in the cabinet 20 may receive an input from a user outside the cabinet 20 and/or provide information to the user through a user interface 24 for selecting a cycle of operation, including operating parameters for the selected cycle. The controller 22 may also control the operation of the laundry treating appliance 10 to implement a selected cycle of operation.

Figure 2:
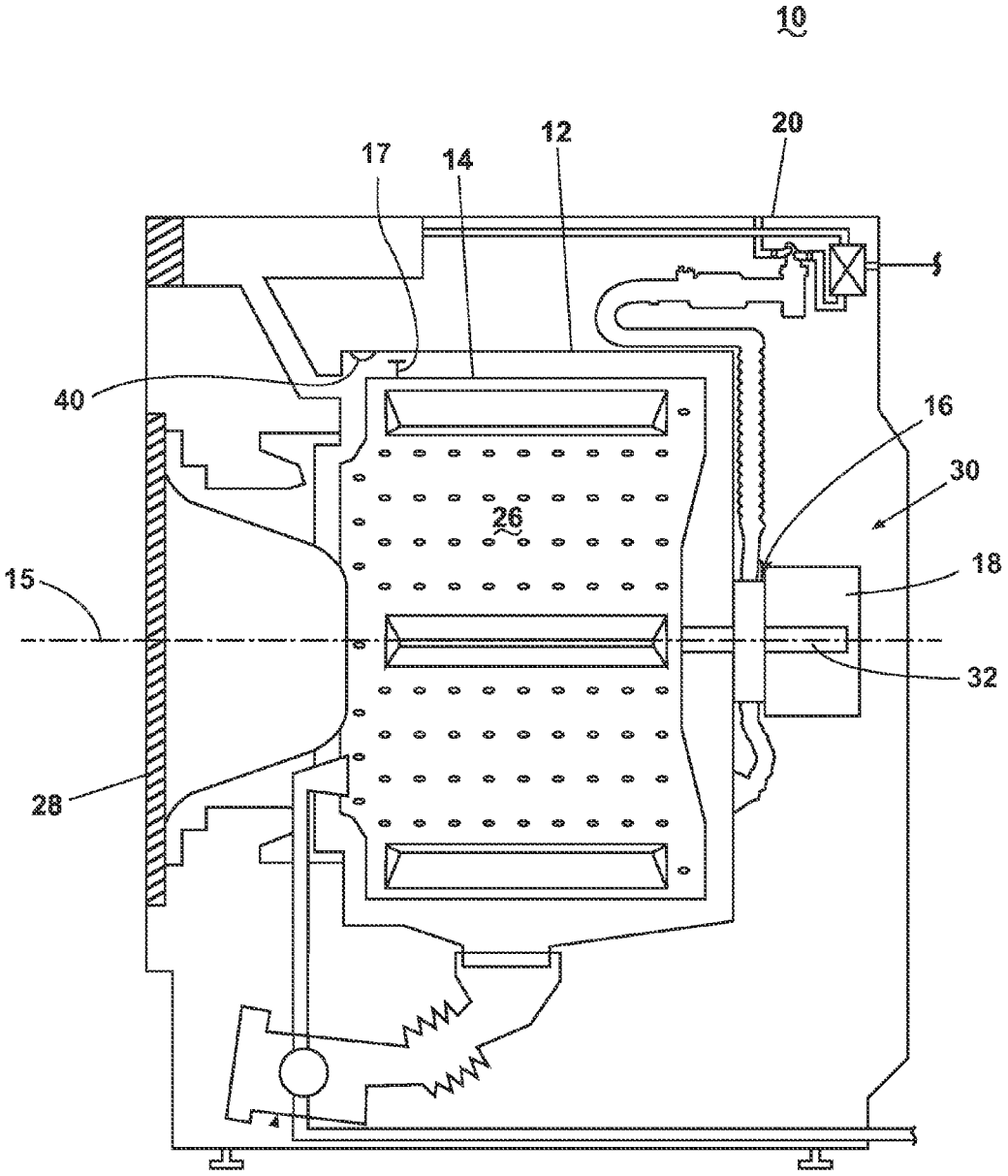
FIG. 2 is a schematic vertical sectional view of the exemplary laundry treating appliance illustrated in FIG. 1 in the form of a clothes washing machine.

As illustrated in FIG. 2, the laundry treating appliance 10 may include a stationary imperforate tub 12, enclosing a perforated drum 14 rotatable by a drive assembly 30 in a rotational direction about an axis of rotation 15. The drum 14 may define a wash chamber 26 for receiving laundry, accessible through an open face and selectively closeable by the access door 28. The drum 14 may be coupled with the drive assembly 30, which may include a drive shaft 32 rotationally supported in a bearing assembly 16. A motor 18 may be operably coupled with the drive shaft 32 to rotate the drum 14 at various speeds in either a first rotational direction, or a second rotational direction opposite the first rotational direction. The drive shaft 32 may be fabricated of any material having a suitable bending and torsional stiffness. High carbon steel is a non-limiting example of a suitable material.

The motor 18 may be a direct drive motor, for example, a brushless permanent magnet (BPM) motor, an induction motor, a permanent split capacitor (PSC) motor, and the like. Alternately, the motor 18 may be indirectly coupled with the drive shaft 32 via, for example, a belt, as is known in the art.

The laundry treating appliance 10 may further include a liquid supply and recirculation system, including a water supply, a detergent dispenser, valves, a sump, a pump, a drain conduit, a recirculation conduit, a heating element, a steam generator, and the like, none of which is germane to the invention.

Figure 3:
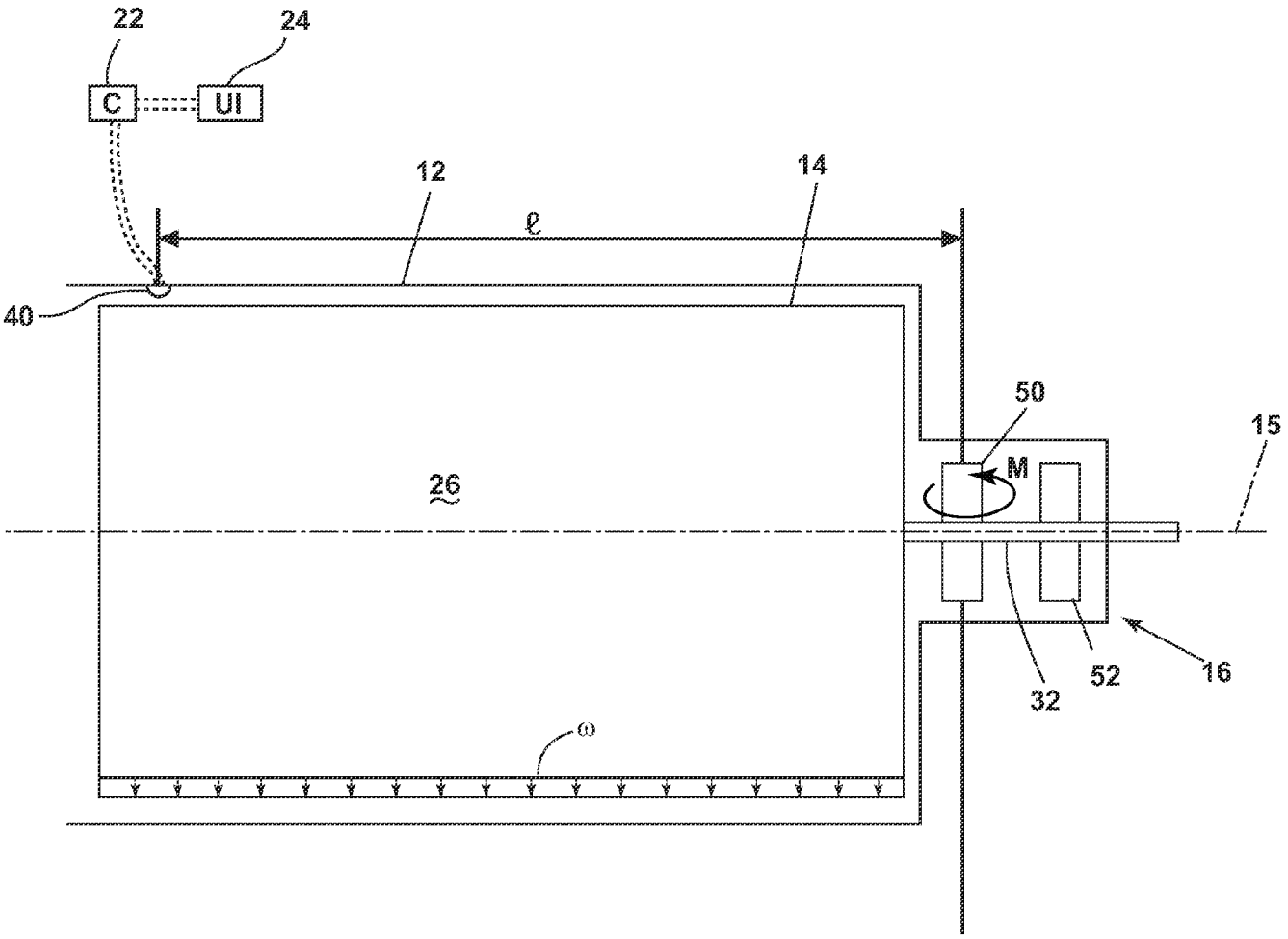
FIG. 3 is a schematic representation of a basket and tub assembly comprising part of the laundry treating appliance illustrated in FIG. 2 with load and distance configurations effecting a bending moment.

Turning now to FIG. 3, the tub 12 may be provided with a fixedly-attached tub bearing assembly 16 having spaced forward and rearward bearings 50, 52, respectively, within which the drive shaft 32 may be rotatably supported. Thus, the motor 18 and drive shaft 32 may rotate about the axis of rotation 15, the drive shaft 32 rotating within the tub bearing assembly 16, the drive shaft 32 coupled with the drum 14 for rotating the drum 14 about the axis of rotation 15.

A proximity sensor 40 may be mounted at a suitable location for generating an output signal that may be proportional to a distance (also referred to herein as "deflection") 17 separating the drum 14 from the tub 12. In FIGS. 2 and 3, the proximity sensor 40 is illustrated attached to the tub 12 at a location enabling the sensing of the distance 17 between the sensor 40 and the open end portion of the drum 14. The proximity sensor 40 may be operably coupled with the controller 22 through suitable wire leads or a wireless configuration. A suitable sensor may be a magnetic field sensor capable of sensing a metal portion of the drum 14. Other suitable sensors may include an optical sensor or a sonic sensor.

The controller 22 may be operably coupled with the motor 18 and the proximity sensor 40, and configured to supply a control signal to the motor 18 to effect the rotation of the drum 14 about the axis of rotation 15 and receive a data signal from the proximity sensor 40. Alternatively, a separate controller (not shown) may be coupled with the proximity sensor 40. The controller 22 may be a combination of a machine controller and motor controller within one physical location, or a practical implementation may require their physical separation.

Figure 4:
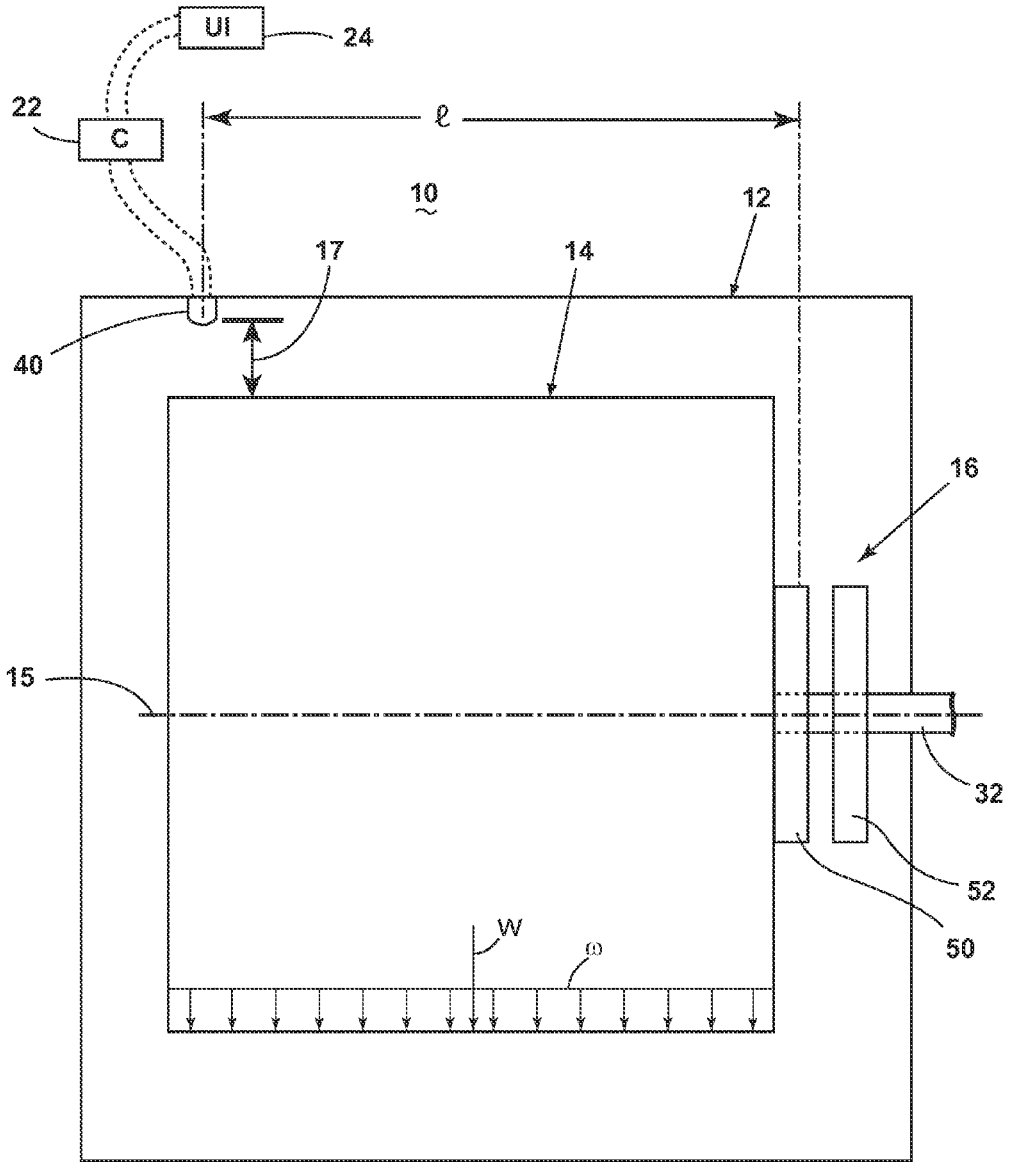
FIG. 4 is a schematic vertical sectional view of portions of the exemplary laundry treating appliance of FIG. 2 illustrating variables utilized in calculating a bending moment from a measured deflection.

Referring also to FIG. 4, a drive shaft bending moment may be calculated by using an output from a sensor that may measure the drive shaft bending moment directly (such as shaft-mounted strain gages). However, deflection associated solely with the drive shaft 32 may be ignored, as the drive shaft/bearing assembly configuration may be associated with a drive shaft deflection that is minimal compared with deflection associated with the drum 14 and with an unbalanced laundry load. The deflection of interest may relate to one or more of the mass of the drum 14, mass of the laundry load, mass of liquid retained in the laundry load, and the unbalanced load. The unbalanced load may produce the largest bending moment. With drive shaft bending moment ignored, the bending moment of interest, e.g. from the unbalanced load, may be associated with deflection of the drum 14.

The proximity sensor 40, such as an inductive proximity sensor, may discretely or continuously measure a distance 17 between the tub 12 and the rotating drum 14, and transmit a data signal proportional to such distance 17 to the controller 22. As the bending moment increases, the difference between drum-to-tub minimum and maximum distances 17 may increase. As the drum 14 rotates, alternately moving closer to, then farther from, the sensor 40, output signals from the sensor 40 may track this increase and decrease accordingly.

The proximity sensor 40 may be used in combination with other sensors, such as accelerometers, load cells, and the like, for detection of a load unbalance. A dedicated circuit board (not shown) coupled with the sensor 40 may be used for signal conditioning and signal processing, with the processed data sent to the controller 22. Alternatively, a raw signal or a signal undergoing limited conditioning may be delivered to the controller 22, with remaining signal conditioning and signal processing completed by the controller 22.

The output from the sensor 40 may be used to estimate the bending moment, since the bending moment is proportional to the drum-to-tub distance variation. In mathematical terms:

$$M(L_{ub})=f(g_{max}-g_{min})$$

where

M=bending moment of drive shaft, $L_{ub}$=load unbalance, $g_{max-gmin}$=difference between maximum and minimum drum-to-tub distance, and f=generalized nonlinear function.

Known beam bending moment formulas may be utilized to correlate distances 17 measured by the proximity sensor 40 to a bending moment acting at a selected location along a beam.

The mass of the drum 14, laundry load, and liquid retained in the laundry load, may be modeled as a uniform load, ω, extending along a cantilevered beam, with the fixed end taken at the drum wall (i.e. the wall attached to the drive shaft 32), and the free end taken as the opposite open end of the drum 14 used to determine the bending moment at the bearing assembly 16.

Figure 5A:
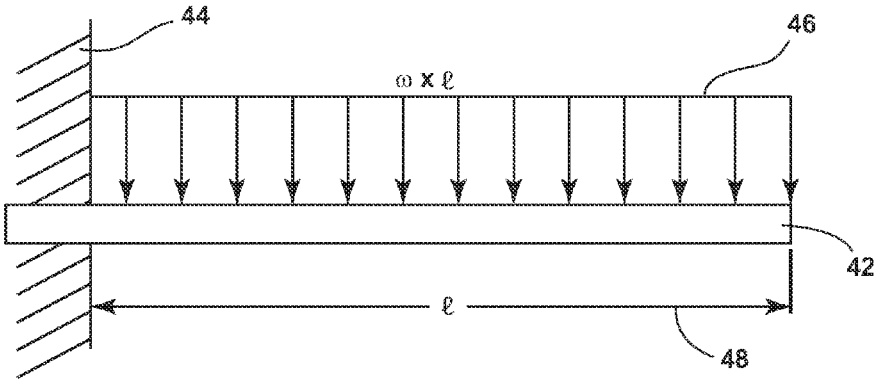
FIG. 5A is a schematic side view of a uniform load along a cantilevered beam forming the basis for a calculation of bending moment from a measured deflection.

The uniform load, ω, is illustrated schematically in FIGS. 3 and 4 extending along the drum 14, which may be modeled as a uniform load 46 acting over a cantilevered beam 42 as illustrated in FIG. 5A. The bearing assembly 16 may define a baseline for determining length, with the location of the proximity sensor 40 defining the length, l. Alternatively, the end wall of the drum 14 may be taken as the baseline for determining length. The bearing assembly 16 may be modeled as the fixed base 44, with a uniformly distributed laundry load over the length of the drum 14 modeled as the uniformly distributed load 46. The beam length, l, may be taken as the distance between the bearing assembly baseline and the center of the proximity sensor 40.

The beam 42 is fixedly coupled with a fixed base 44 so that a maximum bending moment is developed where the beam 42 engages the base. Thus:

$$M_{max}(\text{at fixed end}) = \frac{\omega l^2}{2},$$

and $$\Delta_{max}(\text{at free end}) = \frac{\omega l^4}{8EI},$$

where

ω=uniform load, lb/in, l=beam length, in,

M=moment, in-lbs,

Δ=deflection, in,

E=Young's modulus of elasticity, psi, and

I=moment of inertia, $in^4$.

Combining the formulas for $M_{max}$ and $\Delta_{max}$, and solving for $M_{max}$, leads to:

$$M_{max} = \Delta_{max}\frac{4EI}{l^2}.$$

Knowing the deflection, Δ, the bending moment, M, may be calculated. This approach may be utilized for the laundry treating appliance 10.

For a selected drum 14, bearing assembly 16, drive shaft 32, and related components, a maximum bending moment can be established which may not be exceeded. A maximum allowable deflection corresponding to the maximum bending moment can also be established empirically. Thus, during a cycle of operation, the deflection 17 can be monitored by the proximity sensor 40 and, if the deflection 17 equals or exceeds the maximum allowable deflection, the controller 22 may direct that corrective action be taken, such as resetting of the drum speed, redistribution of the laundry load within the drum 14, terminating a cycle of operation, terminating a phase of a cycle of operation, setting a maximum rotational speed of the drum 14, or similar measures.

Figure 5B:
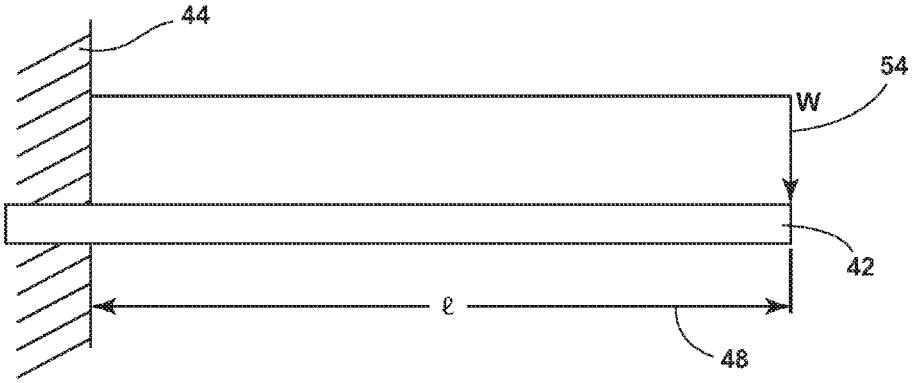
FIG. 5B is a schematic side view of a point load acting on the free end of a cantilevered beam forming the basis for an alternate calculation of bending moment from a measured deflection.

Other formulas may be utilized for differing laundry load configurations. For example, as illustrated in FIG. 5B, if a laundry load accumulates at the front or open end of the drum, the laundry load may be idealized as a point load, W, acting at the front or open end of the drum. This loading configuration may be modeled as a concentrated load 54 acting on the free end of the beam 42, and the formula for a concentrated load, W, at a free end of a cantilevered beam may be utilized as follows:

$$M_{max} = Wl,$$

and $$\Delta_{max} = \frac{Wl^3}{3EI},$$

$$M_{max} = \Delta_{max}\frac{3EI}{l^2}.$$

Figure 5C:
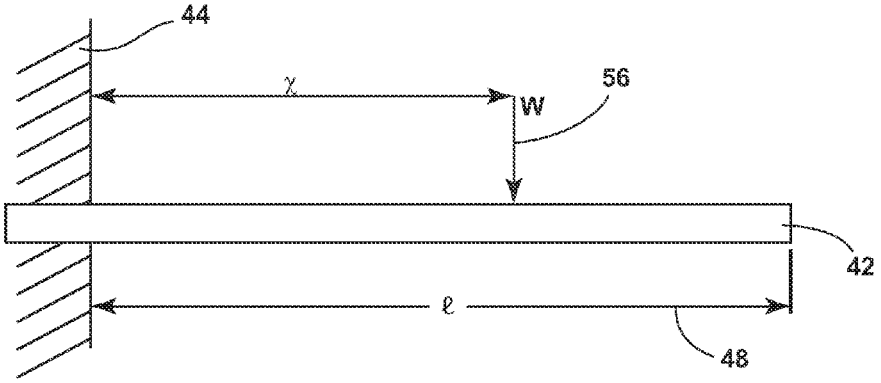
FIG. 5C is a schematic side view of a point load acting on a cantilevered beam between the free end and the fixed base forming the basis for another alternate calculation of bending moment from a measured deflection.

Referring to FIG. 5C, if a laundry load accumulates in a limited area in the drum 14 so that it may be modeled as a point load, W, the loading configuration may be modeled as a concentrated load 56 acting on the beam 42 at a location between the fixed base 44 and the free end of the beam 42. The formula for this load configuration is:

$$M_{max} = Wx,$$

and $$\Delta_{max}(\text{at free end}) = \frac{Wx^2}{6EI}(3l - x),$$

$$M_{max} = \Delta_{max}\frac{6EI}{3lx - x^2}.$$

Figure 6:
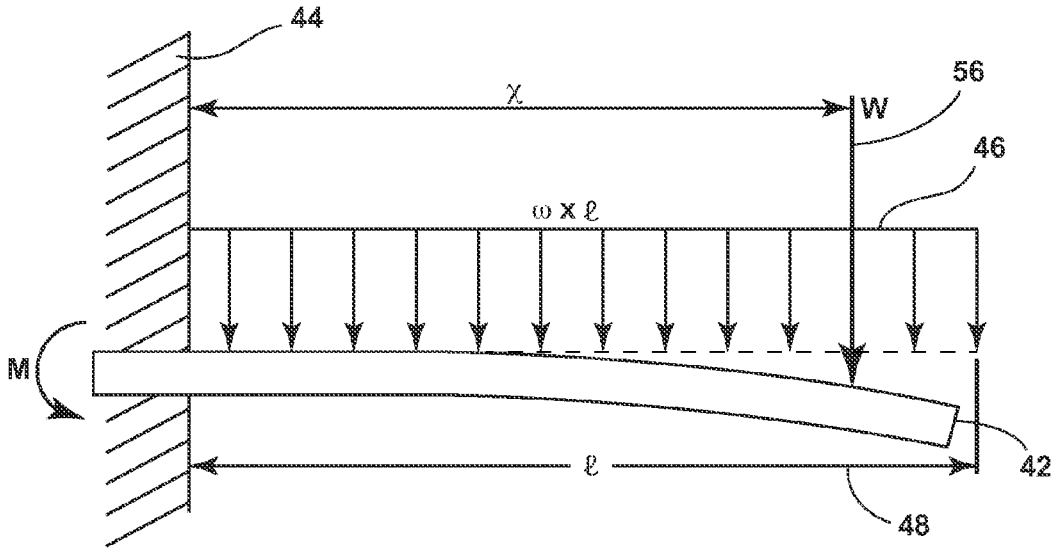
FIG. 6 is a schematic side view of a combined uniform load along a cantilevered beam and point load acting on the cantilevered beam between the free end and the fixed base representative of an actual drum loading forming the basis for yet another calculation of bending moment from a measured deflection.

Moment and deflection may be determined for a combination of a concentrated load and a uniform load as illustrated in FIG. 6. This may represent the moment resulting from the uniform loading 46 of the mass of the drum 14, laundry load, and liquid retained in the laundry load, plus the moment resulting from the concentrated unbalanced load 56. Thus, from FIG. 5A:

$$M_{max}(\text{at fixed end}) = \frac{\omega l^2}{2},$$

and from FIG. 5C:

$$M_{max} = Wx.$$

Moments can be added, so that $$M_{total} = \frac{\omega l^2}{2} + Wx.$$

The laundry load may be determined through a known load sensor (not shown), by a static displacement sensed by the proximity sensor 40, or other known apparatus and/or methodologies. With a Young's modulus of elasticity, and moment of inertia, which are both known for a given appliance, the deflection 17 determined by the proximity sensor 40 may be equated to a bending moment.

Rather than basing bending moment on a sensed distance between the tub 12 and the drum 14, bending moment may be based upon a change in the distance between the tub 12 and the drum 14. The change in distance may be correlated to a pre-selected reference distance. This reference distance may be taken as the distance between the tub 12 and the drum 14 when the drum 14 is stationary. The reference distance may also be taken as a distance when the drum 14 is empty of laundry. The reference distance may also be taken as an average distance between the tub 12 and the drum 14 with the drum 14 rotating at a relatively slow speed.

The average distance may be based upon multiple distance determinations over at least one full rotation of the drum 14. The average distance may also be determined with the drum 14 rotating at a high speed. The change in distance may be equated to the magnitude of the bending moment by sensing a distance at a pre-selected point, and comparing the distance at the pre-selected point to a corresponding pre-determined value for the magnitude of the bending moment. Sensing a change in the distance between the tub 12 and the drum 14 may consist of sensing a change in distance at at a fixed axial location of the tub 12.

By using a direct sensing method to calculate drum shaft bending moment, rather than using motor power or torque, a more accurate and expedited estimation of bending moment may be obtained. There may be no need to ramp up to a selected drum rotation speed through various intermediate speed plateaus, and no need to accelerate to the selected drum rotation speed to determine whether load redistribution may be necessary. Moreover, drum-to-tub impacts may be minimized. Consequently, cycle time may be shortened, vibration level may be reduced, and overall reliability of the appliance may be enhanced.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance comprising a tub, a rotatable drum provided within the tub, and a drive shaft rotationally supported in a bearing assembly and having one end extending through the tub and mounted to the drum, the method comprising:

sensing a magnitude of a change in a distance between the tub and the drum while the drum is rotated;

equating the magnitude of the change in the distance to a magnitude of a bending moment acting on the bearing assembly; and controlling the operation of the laundry treating appliance based on the magnitude of the bending moment.

2. The method of claim 1 wherein sensing the magnitude of the change comprises sensing the magnitude of the change relative to a reference distance between the tub and the drum.

3. The method of claim 2 wherein the reference distance is the distance between the tub and the drum when the drum is not rotating.

4. The method of claim 3 wherein the reference distance is determined when the drum is empty of laundry.

5. The method of claim 2 wherein the reference distance is an average distance between the tub and the drum.

6. The method of claim 5 wherein the reference distance is determined when the drum is empty of laundry.

7. The method of claim 5 wherein the reference distance is determined when the drum contains laundry.

8. The method of claim 5 wherein the average distance is based on multiple distance determinations over at least one full rotation of the drum.

9. The method of claim 1 wherein equating the magnitude of the change in the distance to the magnitude of the bending moment comprises sensing the magnitude and comparing the magnitude to a corresponding predetermined value for the magnitude of the bending moment.

10. The method of claim 1 wherein equating the magnitude of the change in the distance to the magnitude of the bending moment comprises calculating the bending moment based on the magnitude of the change.

11. The method of claim 1 wherein sensing magnitude of the change in the distance between the tub and the drum comprises sensing at least one change in the distance at a fixed axial location of the tub.

12. The method of claim 11 wherein the fixed axial location of the tub is closer to an open end of the tub than an end of the tub through which the drive shaft extends.

13. The method of claim 1 wherein controlling the operation of the laundry treating appliance comprises at least one of: terminating a cycle of operation, terminating a phase of a cycle of operation, setting a rotational speed of the drum, and setting a maximum rotational speed of the drum.

* * * * *